United States Patent [19]

Scott

[11] 4,350,841

[45] Sep. 21, 1982

[54] ELECTRICAL CONNECTOR

[75] Inventor: William J. Scott, Sycamore, Ill.

[73] Assignee: Ideal Industries, Inc., Sycamore, Ill.

[21] Appl. No.: 108,597

[22] Filed: Dec. 31, 1979

Related U.S. Application Data

[63] Continuation of Ser. No. 936,589, Aug. 24, 1978, abandoned.

[51] Int. Cl.[3] ..... H01R 4/22

[52] U.S. Cl. ..... 174/87; D13/26

[58] Field of Search ..... 174/87; D13/26

[56] References Cited

U.S. PATENT DOCUMENTS

| | | | |
|---|---|---|---|
| D. 82,351 | 10/1930 | Sirwell | D13/26 |
| D. 183,969 | 11/1958 | Holmes | 174/87 X |
| D. 186,598 | 11/1959 | Schinske | 174/87 X |
| D. 186,599 | 11/1959 | Schinske | D13/26 |
| D. 190,378 | 5/1961 | Schinske | D13/26 |
| D. 190,582 | 6/1961 | Schinske | D13/26 |
| D. 190,583 | 6/1961 | Schinske | D13/26 |
| D. 200,538 | 3/1965 | Esser | D13/26 |
| D. 214,446 | 6/1969 | Oprins | D13/26 |
| D. 223,611 | 5/1972 | Anderson | 174/87 X |
| 3,075,038 | 1/1963 | Schinske | 174/87 |
| 3,297,816 | 1/1967 | Waddington | 174/87 |

*Primary Examiner*—B. A. Reynolds
*Assistant Examiner*—D. A. Tone
*Attorney, Agent, or Firm*—Kinzer, Plyer, Dorn & McEachran

[57] ABSTRACT

This is an electrical connector of the so-called screw-on type and is concerned with the exterior of such a connector which is specially constructed and arranged to be handled and driven on the stripped ends of the wires by a power operated unit.

7 Claims, 4 Drawing Figures

ELECTRICAL CONNECTOR

This is a Continuation of Ser. No. 936,589, filed Aug. 24, 1978, now abandoned.

SUMMARY OF THE INVENTION

This is concerned with an electrical connector of the so-called screw-on type and is more specifically concerned with a connector that is specifically designed and constructed to be used in or applied by a power-operated wrench or connector driver.

A primary object of the invention is a connector which is constructed to be used in a power-operated wrench or driver and is arranged so that the operator can see the end of it in the driving gun so that he can insert the wire combinations for joining.

Another object is such a connector which is specifically constructed so that in a group of such connectors no two will telescope, one inside the other.

Another object is a connector of the above type which has an extra long skirt to control foldback of wire strands.

Another object is a connector of the above type which is specifically constructed for easy viewing of the wires within the skirt area.

Another object is a connector of the above type which is specifically adaptable or usable to be made with a transparent plastic material.

Other objects will appear from time to time during the ensuing specification and drawings.

DESCRIPTION OF THE PREFERRED EMBODIMENT

Figure 1:
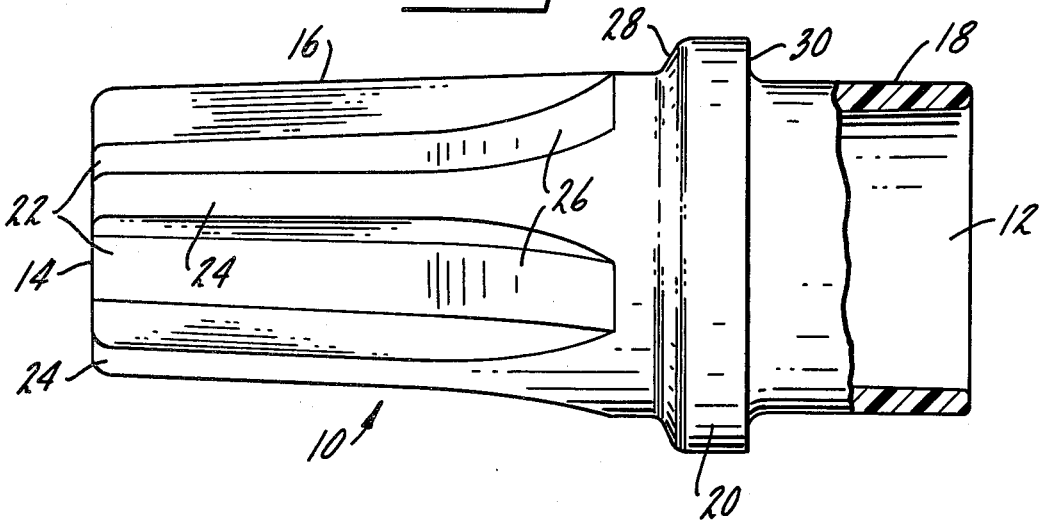
FIG. 1 is a side view of the connector, partly in section.
Figure 2:
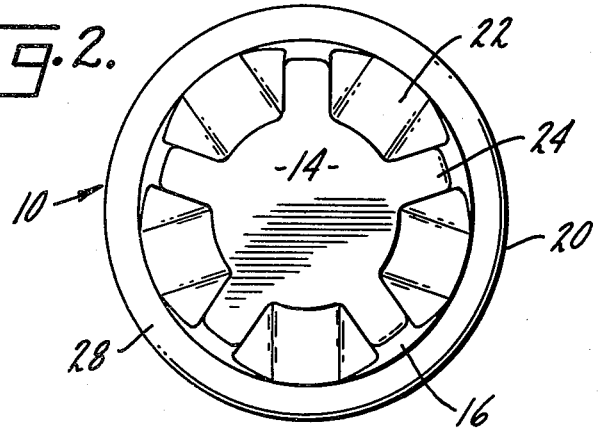
FIG. 2 is an end view, taken from the left end of FIG. 1.

In FIGS. 1 and 2 a connector of the so-called pigtail or screw-on type has been generally shown as including an insulating cap or shell indicated generally at 10 which is open at one end, as at 12, and closed at the other by an end wall, as at 14. The interior of the bore in the cap or shell may be formed, constructed or arranged in any suitable manner so that the cap may be screwed down on the stripped ends of the wires. For example, it may have a coil wire insert, either of the fixed or free spring type, or it may be a cap that is made entirely of plastic and a thread form is molded or formed on the interior thereof so that the cap is a unitary plastic piece which screws down on the stripped ends of two or more wires. Suffice it to say that the details of the interior and how the connector itself is fashioned in its interior bore to grasp, interconnect, and/or screw down on the stripped ends of the wires by a particular interior configuration or structure is not important here.

In the FIG. 1 form it will be noted that the exterior of the connector is divided into two general areas, the first being designated 16 and the second being designated 18, with a flange or radial extension or belt 20 more or less between them or intermediate the ends.

The first area 16 has a plurality of flutes or grooves 22 with upstanding ribs 24 between them so that a knurled or grooved surface is provided on the exterior thereof, with the grooves flaring out or rising to the surface, as at 26, as they approach the flange 20. In the present situation, five such sets of grooves and flutes or ribs have been shown and it should be understood that more or less may be used.

The flange 20 or belt rises or projects outwardly throughout the full 360° peripheral extent of the connector and is larger in diameter than the connector on either side thereof so that the maximum dimension across the connector is at the flange or ring 20. It will be noted that the shoulder or face of the ring toward the fluted end 16 is somewhat angular or on a dihedral, as at 28, while the other shoulder 30 is more or less at right angles for a reason to be explained hereinafter.

From the shoulder or abutment 30, the skirt portion 18 extends in what may be considered a generally smooth cylindrical form, although it may vary somewhat, to the open end 12 which has an inside diameter, shown in cross section in FIG. 1, which is less than the outside diameter of the knurled end 14. Thus the knurled end 14 of one connector will not fit inside of the skirt 18 of another. Thus a group of such connectors in a hopper or box will not telescope, which is important.

The connector in FIGS. 1 and 2 is specifically designed and constructed to be used in automatic driving equipment or semiautomatic devices for screwing or turning such connectors down on the stripped ends of a plurality of electric wires. Such devices are shown, for example, in U.S. Pat. No. 3,016,774, issued Jan. 16, 1962, and assigned to the present assignee. The device may take the form of an upright unit which has an upper cabinet to receive connectors, line them up and feed them, open end first, through a flexible tube to an automatic driver assembly. The driver assembly itself is at the lower end of the tube and is constructed to be power-operated to automatically turn the connectors down on the stripped ends of two or more wires.

Figure 3:
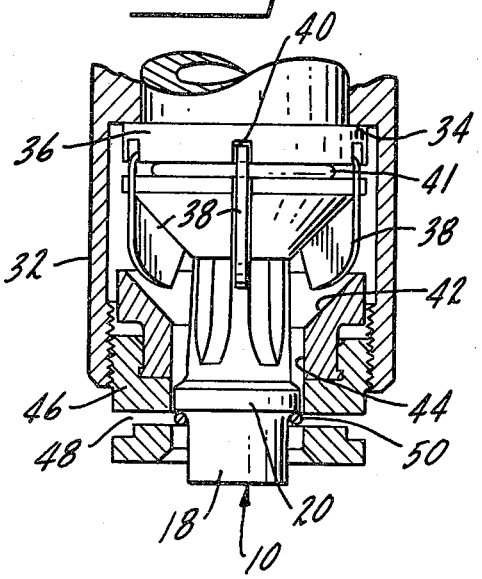
FIG. 3 is a view, partly in section, of such a connector, on a reduced scale, in the lower end of the driver assembly of a device or machine for automatically or semiautomatically screwing or turning connectors down on the stripped ends of wires.
Figure 4:
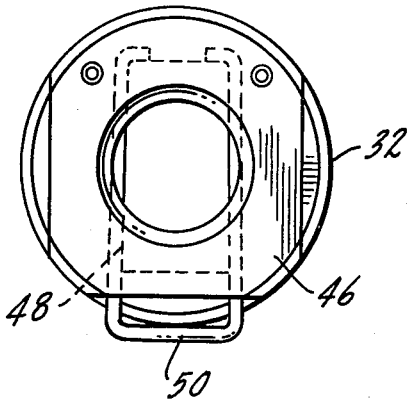
FIG. 4 is an end view of FIG. 3.

The lower end of such a typical driver assembly is shown in FIGS. 3 and 4 as a lower extension on the driver housing at 32 which may have a suitable inwardly disposed shoulder 34. The lower end of the lower drive shaft may have a head 36 which carries a plurality of radially arranged jaws or dogs 38 disposed in radial slots 40 in the head. The dogs may be mounted on a suitable snap ring or wire 41 which fits in a circumferential slot in the head. When the drive shaft is in its lower or extended position and rotated, the dogs move radially inwardly to grip a connector disposed at the turning or working station, one being shown in FIG. 3, and cause the connector to be rotated. When the drive shaft is in its withdrawn or retracted position, which is the position shown in FIG. 3, the dogs are free to move out and allow the connector to pass down through the drive channel. The drive shaft or the head thereof engages the shoulder 34 when the head is in its raised or upper position. As shown, five dogs or jaws are used around the drive head. The dogs are thin enough to fit in the grooves or flutes shown on the connector.

When the driver mechanism is operated, the lower drive shaft will be forced down and the dogs or jaws will be forced in by the cam or conical surface 42 until the jaws grab the connector by its fluted exterior. The passageway which goes through the wrench narrows down to an opening or outlet 44 which is slightly greater in diameter than the outstanding rib 20 so that the connectors may pass through. There is a head 46 which is mounted in the driver housing 32 on the lower end thereof with the conical surface 42 defining a rotating or working or turning station opposite the lower end of the drive shaft. The driver head has slots 48 formed therethrough with a spring-type detent or holder or clip 50 mounted therein in overlapping relationship with the flange or rib 20 on the connector, as shown in FIG. 3, so that the connectors, when they freely fall down through the drive shaft, will be held by the spring, clip or detent 50 and, as shown in FIG. 4, the spring may be pushed inwardly to a wider point so that the connectors will fall or be allowed to be drawn through. The dimensioning of the spring or wire bale 50 is such that in the position shown, the connectors will stop in the FIG. 3 position when they come down the tube. Then a connection is made and with the wires held in the cap, the cap may be drawn out by pulling on the wires and the legs of the spring will spread, thereby functioning as a detent. If the connection or connector is defective, for example the stripped ends of the wires twist off inside of the cap, the operator can press the extended end, shown in FIG. 4, of the wire bale inwardly which will allow the defective connector or connection to fall through which relieves the operator of having to pry the connector out of the lower end of the driver.

The fluting and ribbing on the end 16 of the connector is such that it will match or fit with the dogs of the driver element. At the same time, the smooth cylindrical skirt 18 will project to or possibly beyond the lower end or beyond the bottom surface of the driver element so that the operator can see that a connector is, in fact, in position. Further, the operator can insert the stripped ends of the wires in the end of the connector since it at least comes to the lower end of the driver element. The operator does not have to feel or guess, first, as to whether a connector is positioned in the driving station and, second, whether or not the stripped ends of the wires have, in fact, gone in to the open lower end of the connector. The operator's visibility factor is greatly improved.

The annular ring or rib 20 provides a more positive feeding since the tapered side 16 will more smoothly ride on the machine rails in the hopper and feeding mechanism. Further, the rear shoulder avoids problems with a connector-orienting device, such as in U.S. Pat. No. 2,989,164, issued June 20, 1961. The driving head side, referring to skirt 18 and shoulder 30, rides against the spring retainer, shown in FIG. 4, on the flat side next to the long skirt. This permits the skirt to extend at least to and possibly beyond the hand gun driving head so that the operator can see it to insert the wire combinations for joining. The skirt is long enough so that it may extend out the lower end of the driving gun and is also long enough so that it will control the foldback of any driving strands, where stranded wire is used, so that a shorting or arcing is avoided. Additionally, the uncluttered internal and external diameter permit easy viewing of the wires within the skirt area when the connector is made out of a transparent material, such as a transparent polycarbonate, which is used most advantageously in a connector of this type because viewing through the skirt is desirable to insure that there are no foldbacks of any of the wire strands.

While the preferred form and several variations of the invention have been shown and described, it should be understood that suitable additional modifications, changes, substitutions and alterations may be made without departing from the invention's fundamental theme.

The embodiments of the invention in which an exclusive property or privilege is claimed are defined as follows:

1. In an article of manufacture, a connector for joining the ends of two or more electric wires in the form of a cap made of an insulating material and having a generally central bore open at one end and closed by an end wall at the other end, the exterior of the cap being provided with a shoulder intermediate the ends thereof facing toward the open end of the cap, the shoulder dividing the exterior of the cap generally into two areas, one toward the closed end of the cap and the other toward the open end, the one area having an irregular surface formation to enable the cap to be grasped and turned down on the wires, and the other area being generally cylindrical and of substantial axial extent.

2. The structure of claim 1 further characterized in that the irregular surface is in the form of a plurality of peripherally spaced, axially extending flutes and grooves.

3. The structure of claim 1 further characterized in that the other surface is smooth and generally cylindrical.

4. The structure of claim 3 further characterized in that the central bore, at the open end of the connector, is smaller in diameter than the outside diameter at the end wall at the other end so that in a group of such connectors, no two will telescope one partially inside the other.

5. The structure of claim 1 further characterized in that the exterior of the cap is provided with a radially outstanding flange defining two back-to-back shoulders, one facing toward the open end of the cap and the other facing toward the closed end.

6. The structure of claim 1 in which the shoulder is continuous throughout the 360° peripheral extent of the cap's exterior.

7. The structure of claim 1 further characterized in that the outside diameter of the shoulder is greater than the outside diameter of any other area of the exterior of the cap.

* * * * *